US005605486A

United States Patent [19]

Zheng

[11] Patent Number: 5,605,486

[45] Date of Patent: Feb. 25, 1997

[54] THREE-DIMENSIONAL MODEL STRUCTURES

[76] Inventor: Yu Zheng, 1065 Howard Ave., Covina, Calif. 91722

[21] Appl. No.: 584,519

[22] Filed: Jan. 11, 1996

[51] Int. Cl.[6] ..... A63H 33/08

[52] U.S. Cl. ..... 446/114; 273/156; 273/160; 446/122

[58] Field of Search ..... 273/156, 157 R, 273/160; 446/114, 122, 124

[56] References Cited

U.S. PATENT DOCUMENTS

| | | | |
|---|---|---|---|
| 2,278,327 | 3/1942 | Magnus et al. | 446/124 |
| 3,570,169 | 3/1971 | Jacob | 446/114 |
| 3,701,214 | 10/1972 | Sakamoto | 446/115 |
| 3,790,175 | 2/1974 | Ragnow | 273/160 |
| 3,903,616 | 9/1975 | Gage | 273/160 X |
| 4,055,019 | 10/1977 | Harvey | 446/115 |
| 4,147,007 | 4/1979 | Eppich | 446/114 X |
| 4,731,041 | 3/1988 | Ziegler | 446/115 |
| 4,824,112 | 4/1989 | Roy | 273/157 R |
| 4,874,341 | 10/1989 | Ziegler | 446/109 |
| 5,100,358 | 3/1992 | Volgger | 446/104 |
| 5,172,534 | 12/1992 | Milner et al. | 446/104 X |
| 5,251,900 | 10/1993 | Gallant | 273/157 R |
| 5,350,331 | 9/1994 | Glickman | 446/126 |
| 5,372,450 | 12/1994 | Blodgett | 446/116 X |
| 5,378,185 | 1/1995 | Ban | 446/124 |

FOREIGN PATENT DOCUMENTS

| | | | |
|---|---|---|---|
| 923890 | 2/1947 | France | 273/157 R |

*Primary Examiner*—William H. Grieb
*Attorney, Agent, or Firm*—Raymond Sun

[57] ABSTRACT

A three-dimensional model structure is assembled by interconnecting a plurality of puzzle pieces. Each puzzle piece has at least three outer side edges and at least one joint having a substantially U-shaped mortise defined by a first leg and a second leg. The U-shaped mortise has first and second inner side edges extending from a bottom edge to define an opening. A first corner is defined between the first inner side edge and the bottom edge. The first leg is defined by the first inner side edge and a first outer side edge. A protrusion may be provided along the first outer side edge at a location substantially opposite the bottom edge of the joint, or a bump may be provided at the first corner, to reinforce the first leg. In addition, the top corners connecting a second outer edge and the inner side edges may be curved or chamfered to widen the opening of the U-shaped mortise.

10 Claims, 12 Drawing Sheets

THREE-DIMENSIONAL MODEL STRUCTURES

BACKGROUND OF THE INVENTION

1. Field of the Invention

The present invention relates to three-dimension model structures, and in particular, to puzzle pieces that can be used to assemble three-dimensional model structures. The three-dimensional model structures can be disassembled by removing the puzzle pieces, which can then be used to assemble other three-dimensional model structures.

2. Description of the Prior Art

Puzzles are popular among both children and adults. A two-dimensional puzzle usually involves the selection and sequential assembly of a plurality of puzzle pieces having varying contour to create an original image about a flat sheet board. More complex puzzles include three-dimensional self-standing structures that are assembled by interlocking a variety of puzzle pieces.

Examples of prior three-dimensional structures that are assembled from puzzle pieces are illustrated in U.S. Pat. Nos. 2,278,327 (Magnus et al.), 3,701,214 (Sakamoto) and 5,251,900 (Gallant), in which the puzzle pieces are interconnected by means of dovetail joints. However, these prior puzzle pieces suffer from the drawbacks that (1) the dovetail joints can be become damaged or worn through extended or careless use, and in particular, the tenons or leg portions can be easily snapped off or broken, (2) some of the joints are not easy to connect or join, and (3) the puzzle pieces do not allow the user assemble a wide variety of three-dimensional model objects.

Thus, there remains a need for a plurality of puzzle pieces that can be assembled into a wide variety of different three-dimensional objects. There is also a need for puzzle pieces having joints that are durable and that are easy to connect during assembly of the object.

SUMMARY OF THE DISCLOSURE

In order to accomplish the objects of the present invention, there is provided an object assembled by interconnecting a plurality of puzzle pieces. Each puzzle piece according to the present invention has at least three outer side edges and at least one joint having a substantially U-shaped mortise defined by a first leg and a second leg. The U-shaped mortise has first and second inner side edges extending from a bottom edge to define an opening. A first corner is defined between the first inner side edge and the bottom edge. The first leg is defined by the first inner side edge and a first outer side edge. The puzzle piece also has means for reinforcing the first leg of the joint, and means for widening the opening of the U-shaped mortise.

In one embodiment according to the present invention, the reinforcing means is a protrusion provided along the first outer side edge at a location substantially opposite the bottom edge of the joint. In another embodiment, the reinforcing means is a bump provided at the first corner.

In one embodiment according to the present invention, the widening means are curved top corners connecting a second outer edge and the inner side edges. In a second embodiment, the widening means are chamfered top corners connecting a second outer edge and the inner side edges.

The object assembled by the puzzle pieces of the present invention includes a first puzzle piece having at least one joint and a second puzzle piece having at least one joint. The first and second puzzle pieces are transverse to each other when the joints of the first and second puzzle pieces are interconnected. When so interconnected, the inner side edges of the joint of the first puzzle piece grip the body of the second puzzle piece, and the inner side edges of the joint of the second puzzle piece grip the body of the first puzzle piece.

Thus, the puzzle pieces according to the present invention can be used to assemble a large variety of two and three-dimensional objects. The widened top corners of the joints of the puzzle pieces make it easy for the user to insert one joint into another to create the desired interlocking connection. In addition, the widened top corners and the protrusions or bumps also function to protect the legs of the joints, providing for a more durable set of puzzle pieces that can withstand careless and extended use.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
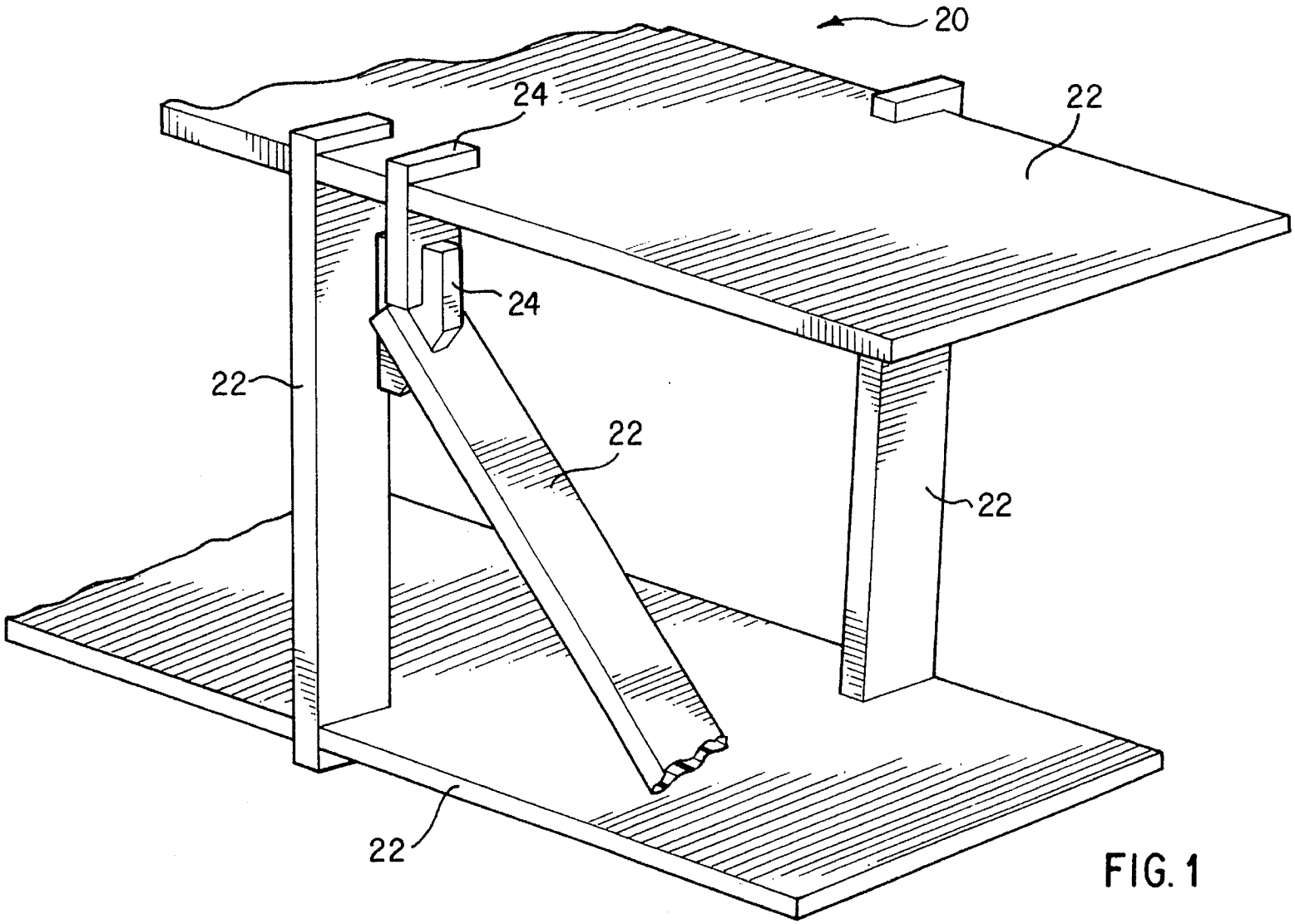
FIG. 1 is a perspective cut-away view of a portion of a three-dimensional model structure assembled with the interlocking puzzle pieces and connector puzzle pieces according to the present invention.

A portion of a three-dimensional self-standing model structure 20 is shown in FIG. 1. Model structure 20 is assembled by connecting a plurality of interlocking puzzle pieces 22 (hereinafter referred to as "puzzle pieces 22") through the use of a plurality of connector puzzle pieces 24 (hereinafter referred to as "connector pieces 24"). The puzzle pieces 22 tend to be larger puzzle pieces that essentially define the walls or sides of the model structure 20, and may have images provided on their surfaces to decorate the model structure 20, as described in greater detail hereinbelow. The connector pieces 24 tend to be smaller puzzle pieces that are used to connect two or more puzzle pieces 22 or connector pieces 24 at joints and other support areas. As explained in further detail below, the connector pieces 24 can also be considered puzzle pieces 22, and vice versa, since they all function to interconnect other pieces 22 and 24. The puzzle pieces 22 and connector pieces 24 according to the present invention can be assembled to create a variety of model structures 20, including but not limited to planes, ships, trains, buildings, furniture, automobiles, animals, plants, and abstract sculptures.

Basic embodiments for the connector pieces 24a–24o according to the present invention are illustrated in FIGS. 317.

Figure 3:
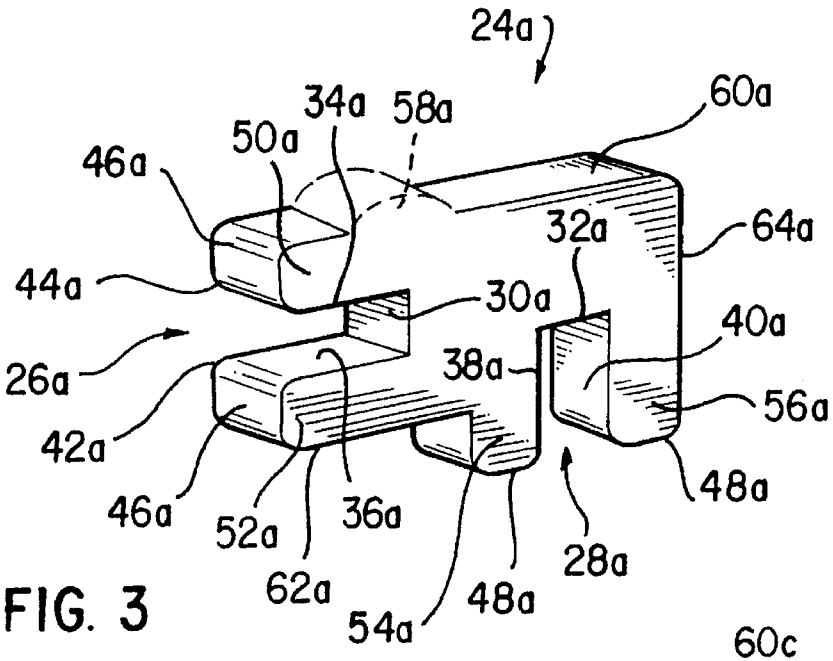

Referring to FIG. 3, a first preferred embodiment of a connector piece 24a has two interlocking joints 26a and 28a provided on different side edges 46a and 48a of the four-sided connector piece 24a. Each interlocking joint 26a and 28a has a substantially U-shaped mortise part that is cut out of an outer side edge 46a, 48a, respectively, of the connector piece 24a. Each substantially U-shaped mortise part of joints 26a and 28a has a bottom edge 30a and 32a, respectively, connected by two inner side edges 34a, 36a and 38a, 40a, respectively. Thus, each joint 26a and 28a is defined by a U-shaped mortise opening having two tenons or legs 50a, 52a and 54a, 56a, respectively, on either side of the mortise opening. The legs 50a, 52a and 54a, 56a are each defined at least an inner side edge and an outer side edge. For example, leg 50a has an inner side edge 34a and an outer side edge 60a.

Figure 4:
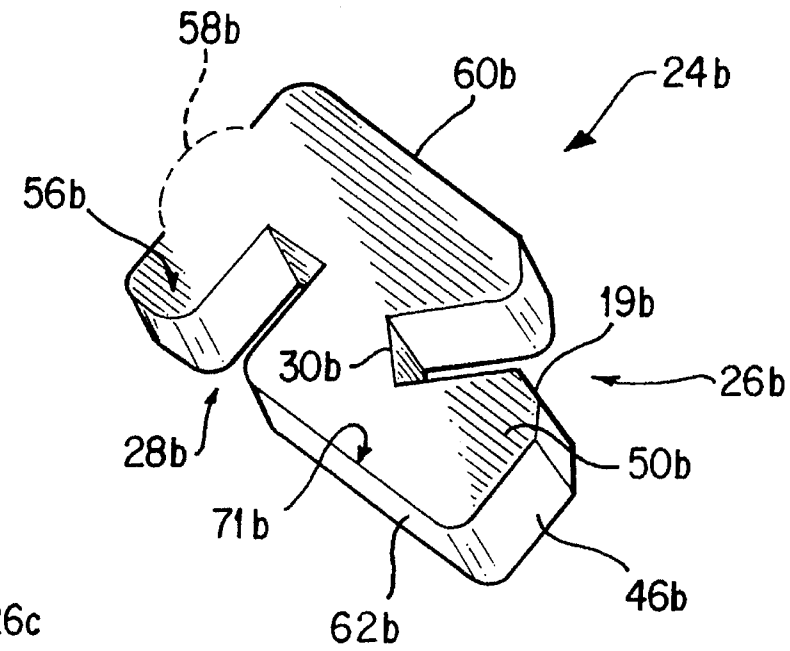
FIGS. 3–17 illustrate various embodiments of the connector puzzle pieces according to the present invention.

The top corner of each U-shaped opening is curved to provide a wider opening. Specifically, for the joint 26a, the top corners 42a and 44a are curved between the two inner side edges 34a, 36a of the joint 26a and the outer side edge 46a of the connector piece 24a. The top corners of the joint 28a are similarly curved. The curved corners widen the opening of the joint 26a and 28a to make it easier to insert a joint from another connector piece 24 or puzzle piece 22 therein. In addition, a curved corner provides a smoother corner which is helpful in preventing the top corners from chipping or becoming damaged after extended use. Although the top corners are illustrated as being curved, they can also take on other configurations without departing from the spirit and scope of the present invention, as long as they provide a substantially smooth and wider opening. For example, the corner edges can be chamfered. See the chamfered top corner 19b in connector piece 24b of FIG. 4.

All joints according to the present invention are preferably provided in the same configuration and size so that they can be used universally to interlock other joints of other puzzle pieces 22 and connector pieces 24. However, the depth of the U-shaped mortise parts can be varied and still facilitate the universal interlocking connections described hereinbelow. Also, it is also possible to provide joints in a few different predetermined configurations and sizes so that certain joints will be adapted for use in interlocking joints of the same size and configuration on other puzzle pieces 22 and connector pieces 24.

In addition, protrusions or bumps may be provided along side edges of the connector piece 24a to provide additional strength to the legs to prevent the legs from snapping or breaking after extended use. For example, a curved or substantially semi-circular protrusion 58a is provided at a location along outer side edge 60a approximately opposite the bottom edge 30a of joint 26a. If protrusion 58a were not provided, the leg 50a would be weakest at the location directly opposite the bottom edge 30a at about the location of the protrusion 58a because that is the location where a long strip of thin mass (i.e., the leg 50a) becomes a wider mass (i.e., the body of the connector piece 24a), and can be easily snapped or broken off at about that location if handled carelessly by the user. Therefore, the protrusion 58a increases the mass at the weakest location of the leg 50a and provides reinforcement and support to that location, making it more difficult to snap or break even after extended or careless use.

As can be seen from connector piece 24a, protrusions 58a are not necessarily provided to support all the legs. For example, leg 54a does not require any such support because the leg 54a is shorter than the other legs 50a, 52a and 56a. Also, although legs 52a and 56a would benefit from protrusions along the outer side edges 62a and 64a, respectively, such protrusions are not provided for connector piece 24a. In addition, some of the connector pieces described hereinbelow, such as connector pieces 24g, 24h, 24i, 24j, 24k, 241 and 24m, do not provide any protrusions for supporting any of the legs. However, it will be appreciated by those skilled in the art that one or more protrusions can be provided for any of the connector pieces described herein without departing from the spirit and scope of the present invention.

The size and shape of the protrusions according to the present invention are not critical, although the protrusions should be large enough to provide sufficient support, and should have an aesthetically pleasing shape that also does not obstruct the interconnection of the interlocking puzzle pieces 22 and the connector pieces 24. For example, the protrusions can have a triangular, square, polygonal, rectangular or any other shape. Also, different protrusions can be provided with different shapes and sizes, on different connector pieces 24 or even on the same connector piece 24.

The shapes of the connector pieces 24 will be largely dictated by the locations and number of the joints. For example, the connector piece 24a has two joints 26a and 28a, but its configuration will change if additional joints are provided along side edges 60a and 64a. Also, the joints can be provided along side edges or corners of connector pieces 24 to provide joints that open at different angles. Different connector pieces 24 can have a different number of joints angled at different planes to provide for connection of multiple puzzle pieces 22 and connector pieces 24 at about the same location. These will be illustrated in connection with the connector pieces described hereinbelow.

For example, substantially four-sided connector piece 24b (FIG. 4) has two joints 26b and 28b, with the joint 26b being provided at the corner of two outer side edges 46b and 60b. The joints 26b and 28b have the same configuration as joints 26a and 28a of connector piece 24a. The top corners of each U-shaped opening of the joints 26b and 28b are also curved or chamfered, and a protrusion 58b is provided to support leg 56b. Note that the location indicated by the arrow 71b opposite the bottom edge 30b of the joint 26b is also a weak location which can be, but in this embodiment is not, supported by a protrusion to protect leg 50b from breaking.

Figure 5:
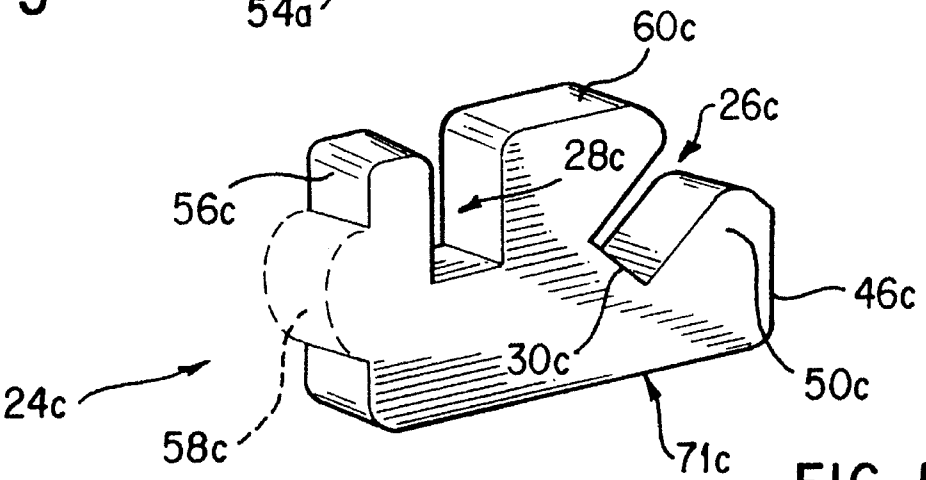

As another example, substantially four-sided connector piece 24c (FIG. 5) has two joints 26c and 28c, with the joint 26c being provided at the corner of two outer side edges 46c and 60c. The joints 26c and 28c have the same configuration as joints 26a and 28a of connector piece 24a. The top corners of each U-shaped opening of the joints 26c and 28c are also curved, and a protrusion 58c is provided to support leg 56c. Note that the location indicated by the arrow 71c opposite the bottom edge 30c of the joint 26c is also a weak location which can be, but in this embodiment is not, supported by a protrusion to protect leg 50c from breaking.

Figure 6:
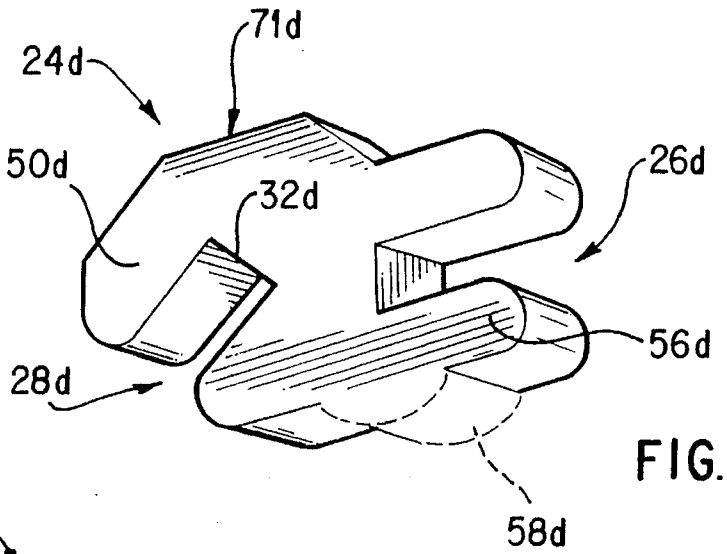

Referring now to FIG. 6, polygonal connector piece 24d has two joints 26d and 28d. The joints 26d and 28d have the same configuration as joints 26a and 28a of connector piece 24a. The top corners of each U-shaped opening of the joints 26d and 28d are also curved, and a protrusion 58d is provided to support leg 56d. Note that the location indicated by the arrow 71d opposite the bottom edge 32d of the joint 28d is also a weak location which can be, but in this embodiment is not, supported by a protrusion to protect leg 50d from breaking.

Figure 7:
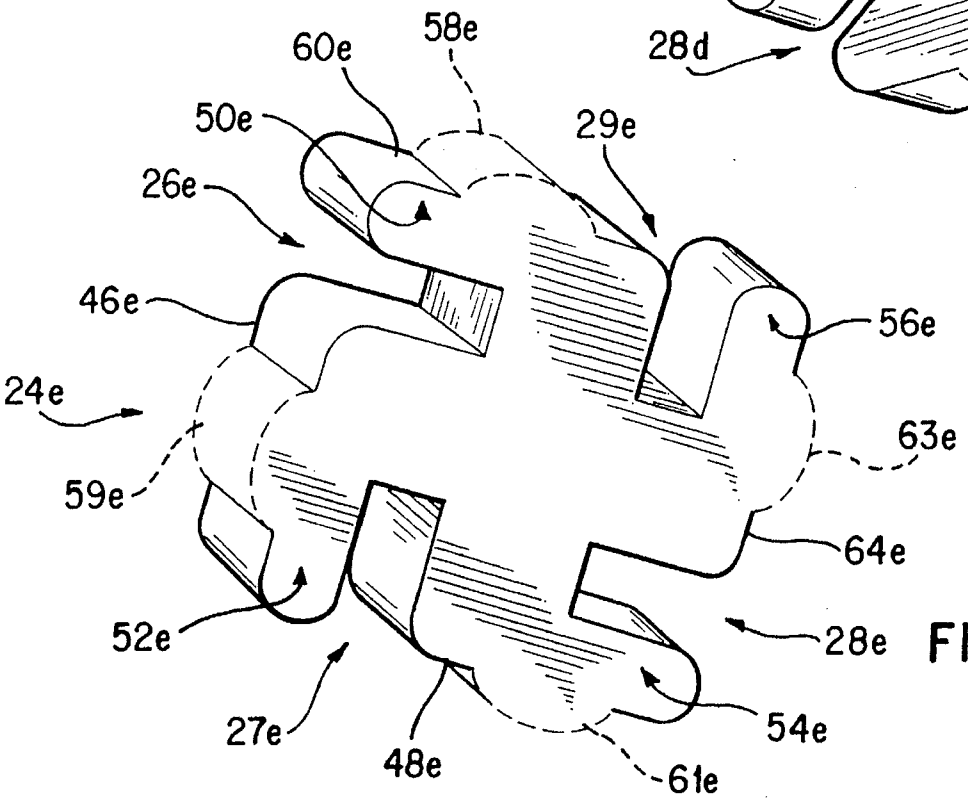

FIG. 7 illustrates a four-sided, substantially square, connector piece 24*e* which has four joints 26*e*, 27*e*, 28*e* and 29*e*, each provided on a separate outer side edge 46*e*, 48*e*, 64*e* and 60*e*, respectively. The joints 26*e*, 27*e*, 28*e* and 29*e* have the same configuration as joints 26*a* and 28*a* of connector piece 24*a*. The top corners of each U-shaped opening of the joints 26*e*, 27*e*, 28*e* and 29*e* are also curved, and protrusions 58*e*, 59*e*, 61*e* and 63*e* are provided along outer side edges 60*e*, 46*e*, 48*e* and 64*e*, respectively, to support legs 50*e*, 52*e*, 54*e* and 56*e*, respectively.

Figure 8:
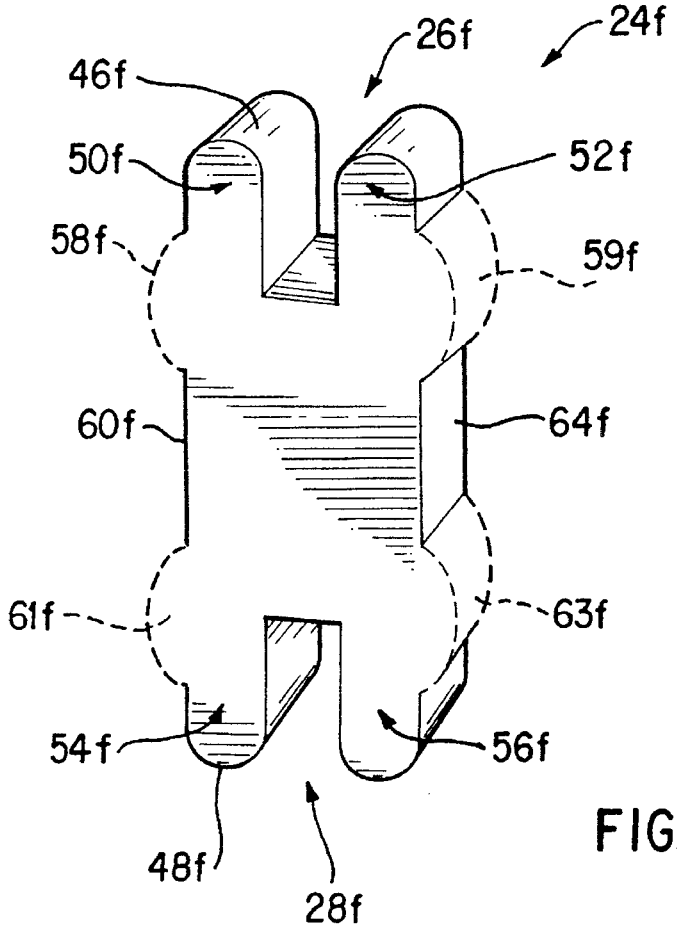

The substantially rectangular connector piece 24*f* of FIG. 8 has two joints 26*f* and 28*f*. The joints 26*f* and 28*f* have the same configuration as joints 26*a* and 28*a* of connector piece 24*a*, and are located on opposite outer side edges 46*f* and 48*f*. The top corners of each U-shaped opening of the joints 26*f* and 28*f* are also curved, and protrusions 58*f*, 59*f*, 61*f* and 63*f* are provided to support legs 50*f*, 52*f*, 54*f* and 56*f*, respectively. In connector piece 24*f*, since the joints 26*f* and 28*f* are located on opposite outer side edges 46*f* and 48*f*, the protrusions 58*f* and 61*f* are provided along outer side edge 60*f* and protrusions 59*f* and 63*f* are provided along outer side edge 64*f*.

Figure 9:
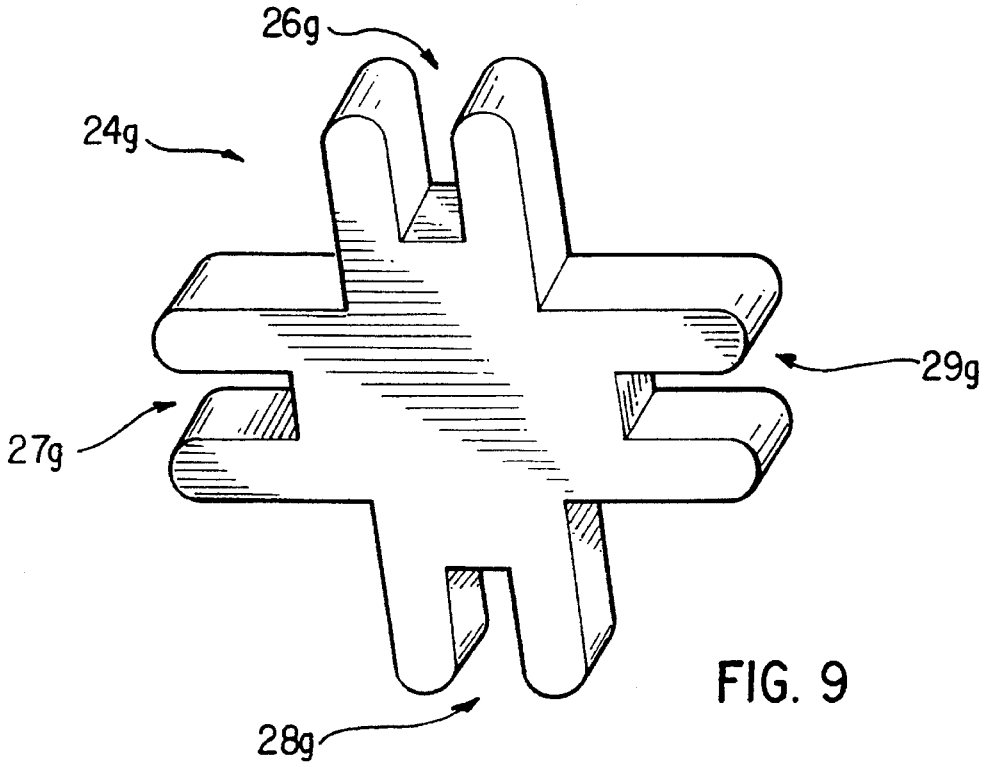

Referring to FIG. 9, the connector piece 24*g* is shaped substantially as a cross or "+" sign, and has four joints 26*g*, 27*g*, 28*g* and 29*g*, with one joint provided at a separate one of the four end-points of the cross. Thus, the connector piece 24g essentially has twelve outer sides edges. The joints 26*g*, 27*g*, 28*g* and 29*g* have the same configuration as joints 26*a* and 28*a* of connector piece 24*a*, and the top corners of each U-shaped opening of the joints 26*g*, 27*g*, 28*g* and 29*g* are also curved.

Figure 10:
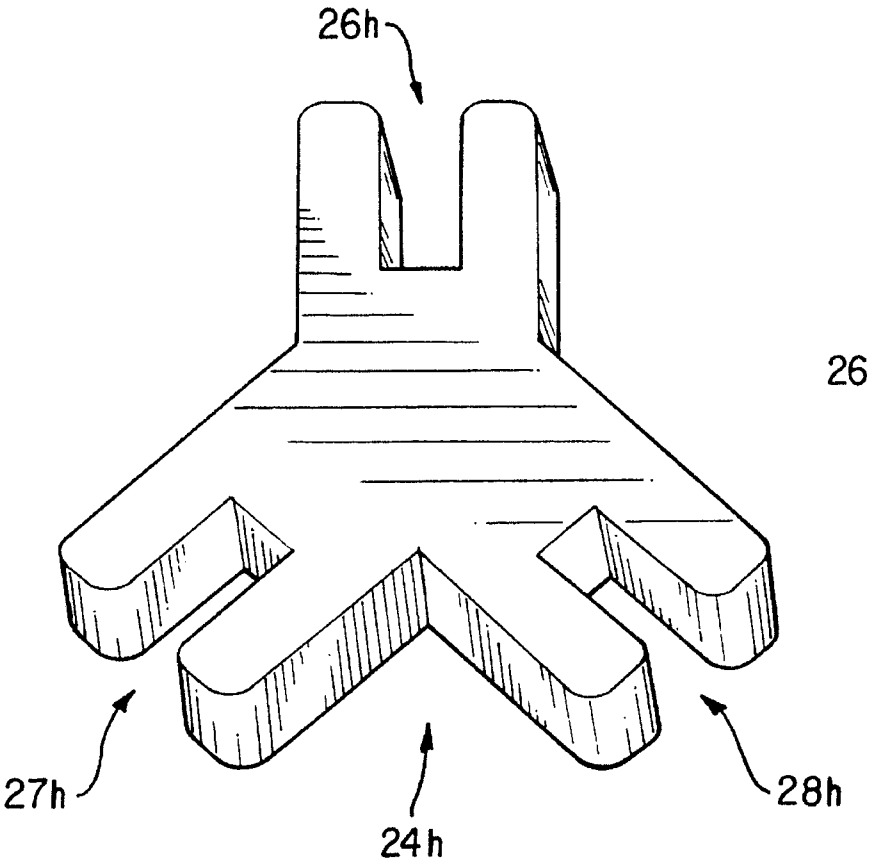

Referring to FIG. 10, the connector piece 24*h* is shaped as an inverted "Y", and has three joints 26*h*, 27*h* and 28*h*, with one joint provided at a separate one of the three end-points of the "Y". Thus, the connector piece 24*h* essentially has nine outer side edges. The joints 26*h*, 27*h* and 28*h* have the same configuration as joints 26*a* and 28*a* of connector piece 24*a*, and the top corners of each U-shaped opening of the joints 26*h*, 27*h* and 28*h* are also curved.

Figure 11:
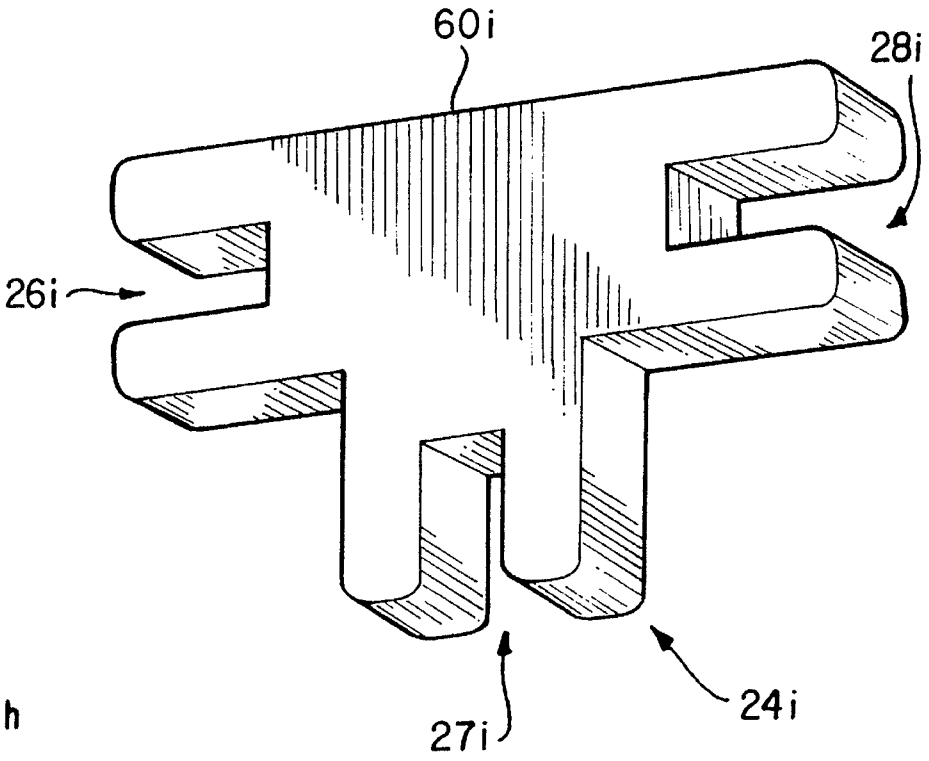

Referring to FIG. 11, the connector piece 24*i* is shaped substantially as a "T" with a short shaft, and has three joints 26*i*, 27*i* and 28*i*, with one joint provided at a separate one of the three end-points of the "T". Thus, the connector piece 24*i* essentially has eight outer side edges. Side edge 60*i* would not have any joints provided thereon. The joints 26*i*, 27*i* and 28*i* have the same configuration as joints 26*a* and 28*a* of connector piece 24*a*, and the top corners of each U-shaped opening of the joints 26*i*, 27*i* and 28*i* are also curved.

Figure 12:
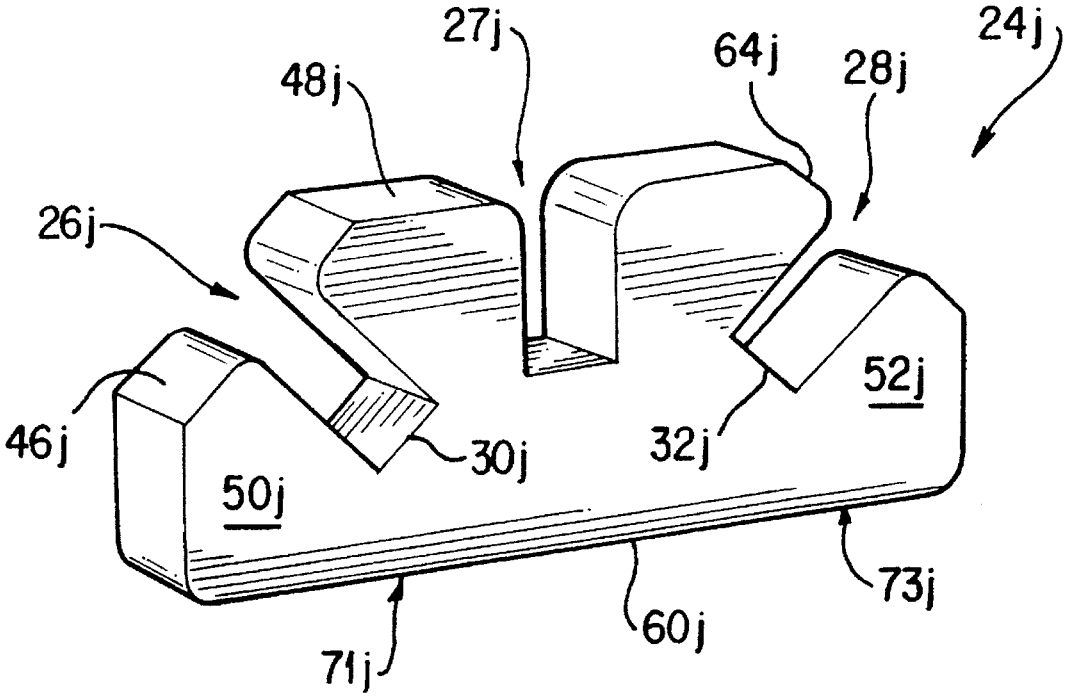

Referring to FIG. 12, the six-sided connector piece 24*j* is shaped as a half-octagon, and has three joints 26*j*, 27*j* and 28*j* provided on adjacent outer side edges 46*j*, 48*j* and 64*j*, respectively, with the long base edge 60*j* not having any joints provided thereon. The joints 26*j*, 27*j* and 28*j* have the same configuration as joints 26*a* and 28*a* of connector piece 24*a*, and the top corners of each U-shaped opening of the joints 26*j*, 27*j* and 28*j* are also curved. Although no protrusions are shown as being provided to support any of the legs, protrusions can be provided without departing from the spirit and scope of the present invention. For example, note that the location indicated by the arrows 71*j* and 73*j* opposite the bottom edges 30*j* and 32*j*, respectively, of joints 26*j* and 28*j* are weak locations which can be, but in this embodiment are not, supported by protrusions to protect legs 50*j* and 52*j* from breaking.

Figure 13:
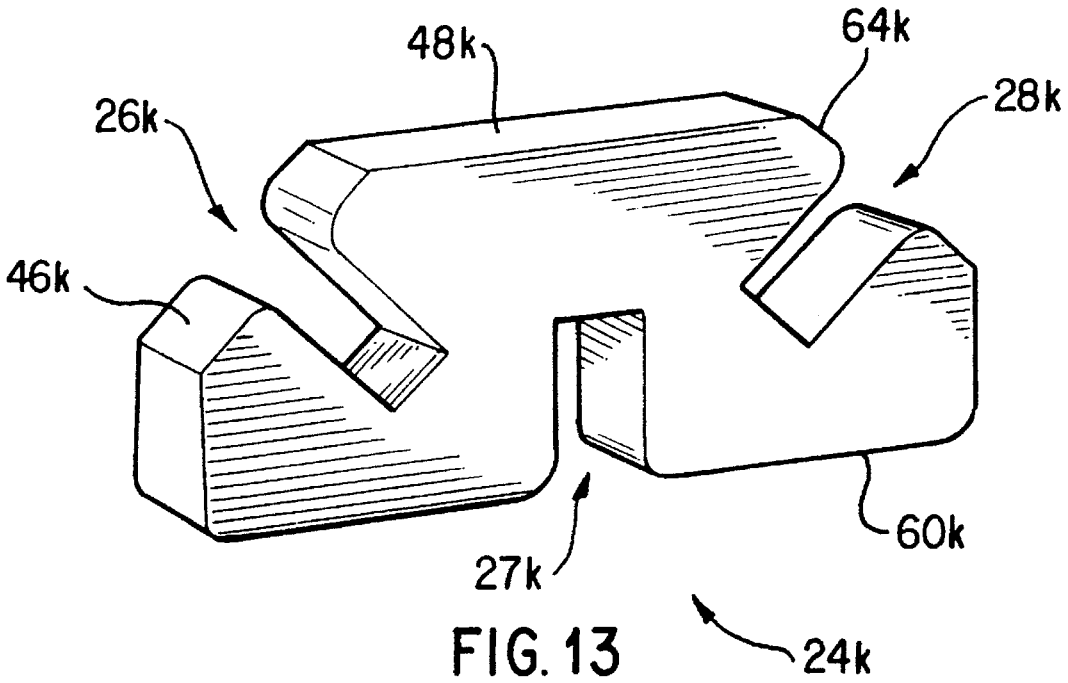

The six-sided connector piece 24*k* of FIG. 13 is similar to connector piece 24*j* of FIG. 12. Connector piece 24*k* is also shaped as a half-octagon, and has three joints 26*k*, 27*k* and 28*k* provided on outer side edges 46*k*, 60*k* and 64*k*, respectively, with the top outer side edge 48*k* not having any joints provided thereon. The joints 26*k*, 27*k* and 28*k* have the same configuration as joints 26*a* and 28*a* of connector piece 24*a*, and the top corners of each U-shaped opening of the joints 26*k*, 27*k* and 28*k* are also curved.

Figure 14:
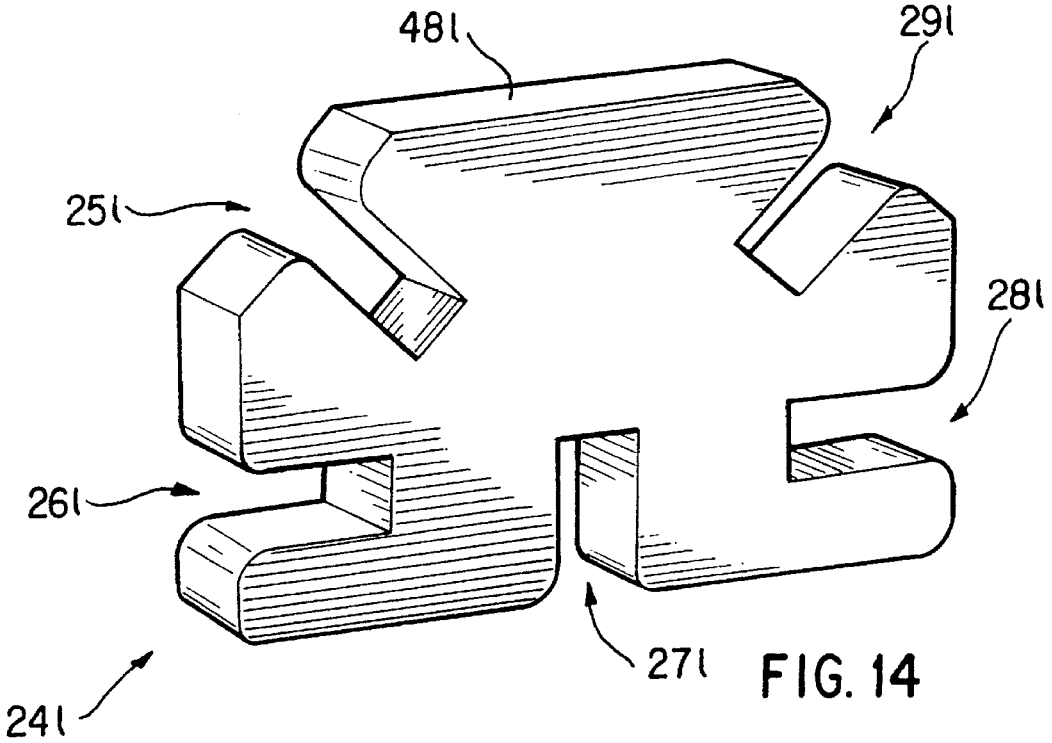

Referring to FIG. 14, the six-sided connector piece 241 is shaped substantially as a half-octagon, and has five joints 251, 261, 271, 281 and 291 provided all the side edges except for the top side edge 481. The joints 251, 261, 271, 281 and 291 have the same configuration as joints 26*a* and 28*a* of connector piece 24*a*, and the top corners of each U-shaped opening of the joints 251, 261, 271, 281 and 291 are also curved.

Figure 15:
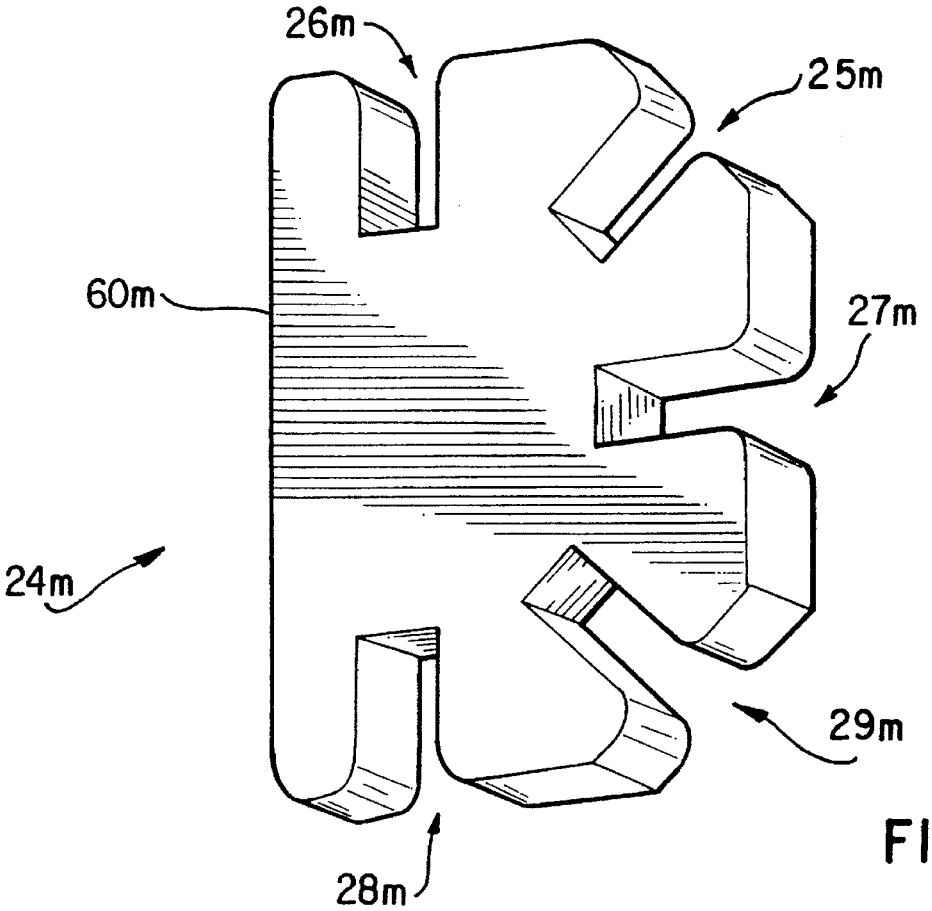

The six-sided connector piece 24*m* of FIG. 15 is similar to connector piece 241 of FIG. 14. Connector piece 24*m* is also shaped substantially as a half-octagon, and has five joints 25*m*, 26*m*, 27*m*, 28*m* and 29*m* provided all the outer side edges except for the long base edge 60*m*. The joints 25*m*, 26*m*, 27*m*, 28*m* and 29*m* have the same configuration as joints 26*a* and 28*a* of connector piece 24*a*, and the top corners of each U-shaped opening of the joints 25*m*, 26*m*, 27*m*, 28*m* and 29*m* are also curved.

Figure 16:
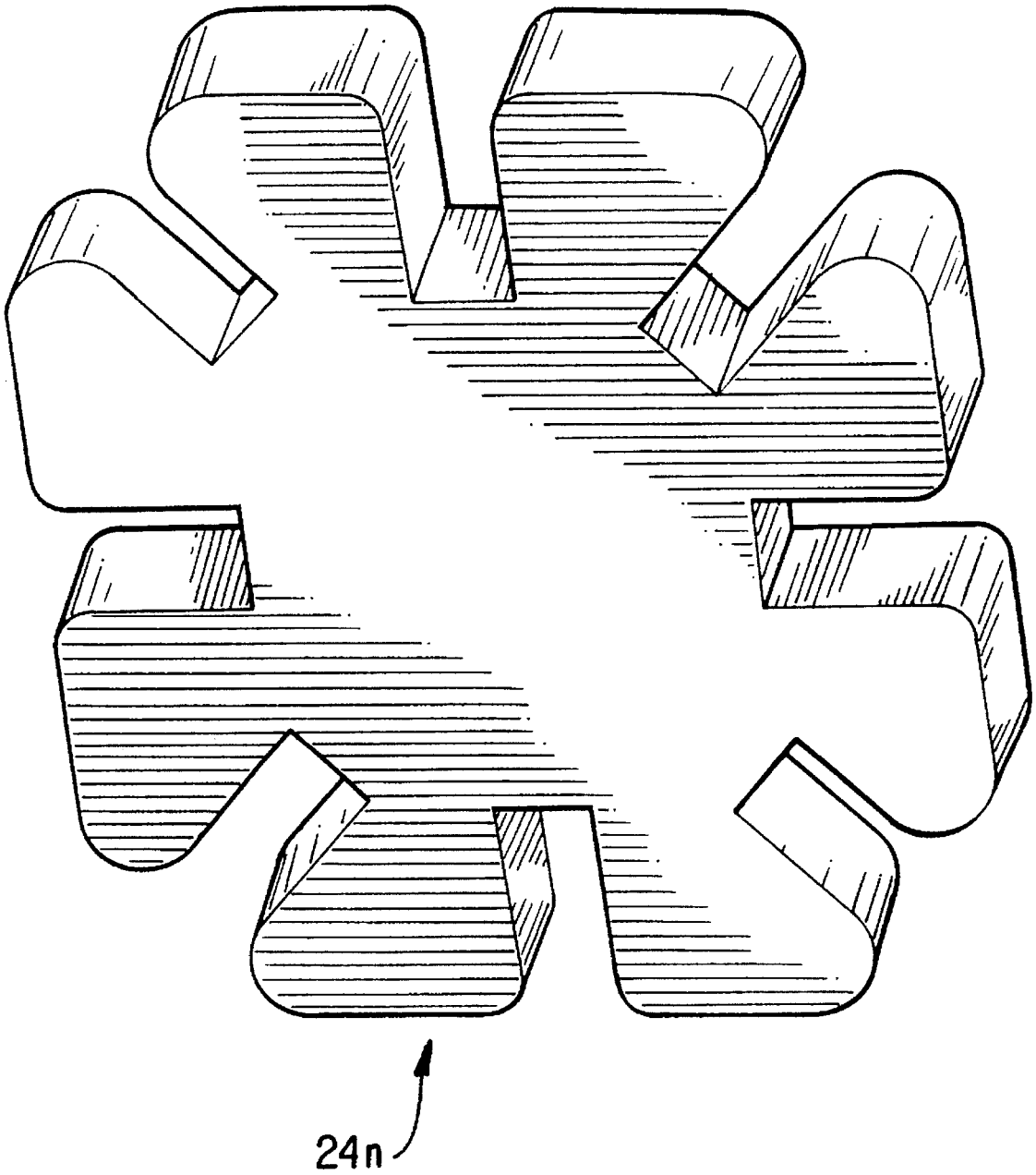

Referring to FIG. 16, the eight-sided connector piece 24*n* is shaped substantially as an octagon, and has eight joints, with one joint provided on each outer side edge. The joints have the same configuration as joints 26*a* and 28*a* of connector piece 24*a*, and the top corners of each U-shaped opening of the joints are also curved. Note that protrusions cannot be provided on an opposite external outer side edge of each joint to support any of the legs of connector piece 24*n* because the side edge opposite the weak locations of each leg is the U-shaped mortise part of another joint.

Figure 17:
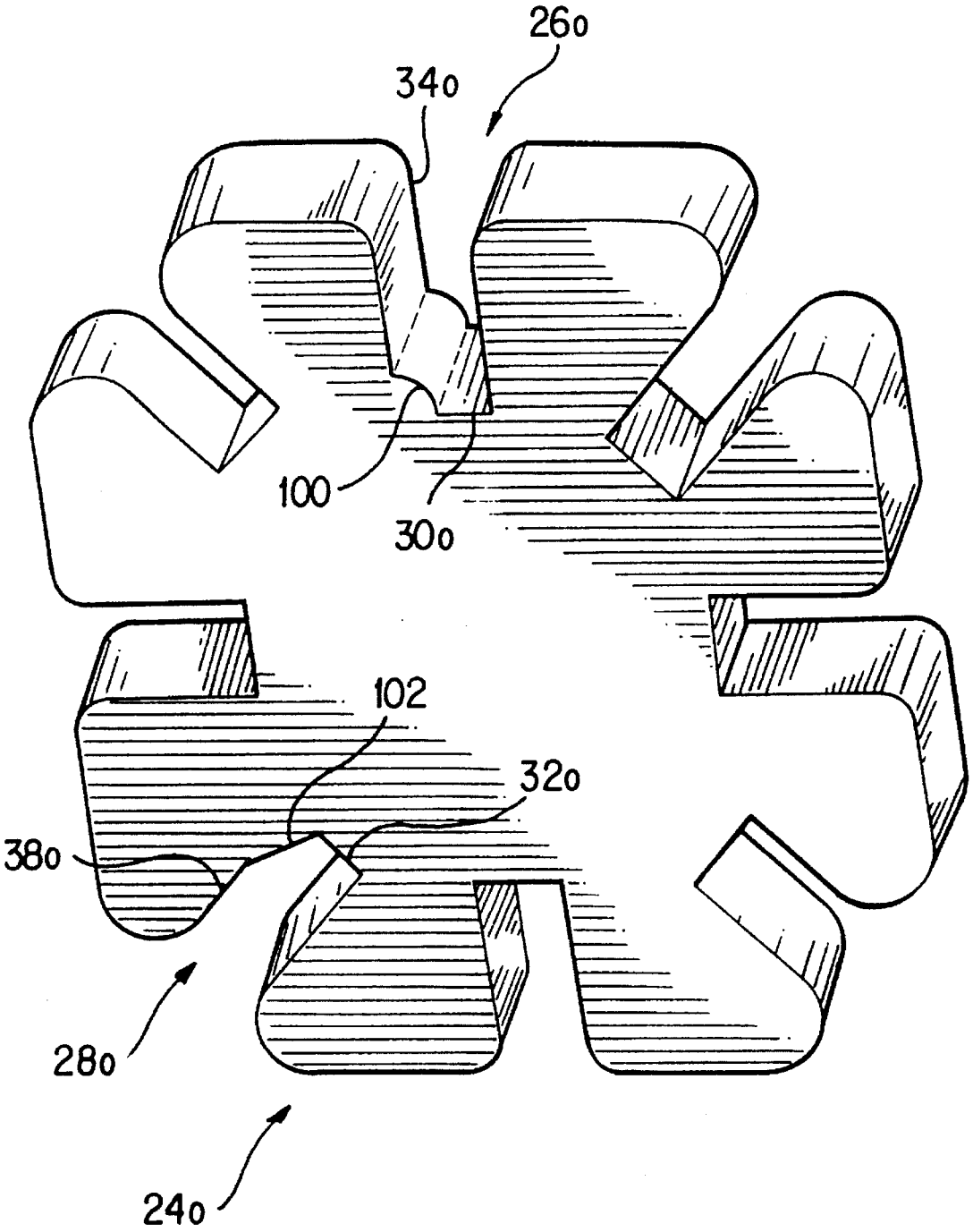

Therefore, to provide support and reinforcement to the legs of connector piece 24*n*, bumps can be provided at the corners of a bottom edge and an inner side edge of the U-shaped joint to provide the increased mass at the weakest location. Referring to FIG. 17, the connector piece 24*o* is the same as the connector piece 24*n*, except that a joint 26*o* is shown as having a bump 100 provided at the corner between bottom edge 30*o* and inner side edge 34*o*. The bump 100 is essentially shaped as a quarter of a cylinder, but the bump 100 can be provided in other shapes and sizes without departing from the spirit and scope of the present invention. For example, the bump 102 in joint 28*o* is an angled ramp extending from the inner side edge 38*o* to the bottom edge 32*o*. Also, even though not shown in connection with the other connector pieces 24, it will be appreciated that similar bumps 100 or 102 can be provided for use with any of the connector pieces 24 without departing from the spirit and scope of the present invention. Also, it will be appreciated by those skilled in the art that other structural alternatives can be provided to reinforce the legs without departing from the spirit and scope of the present invention.

Figure 2:
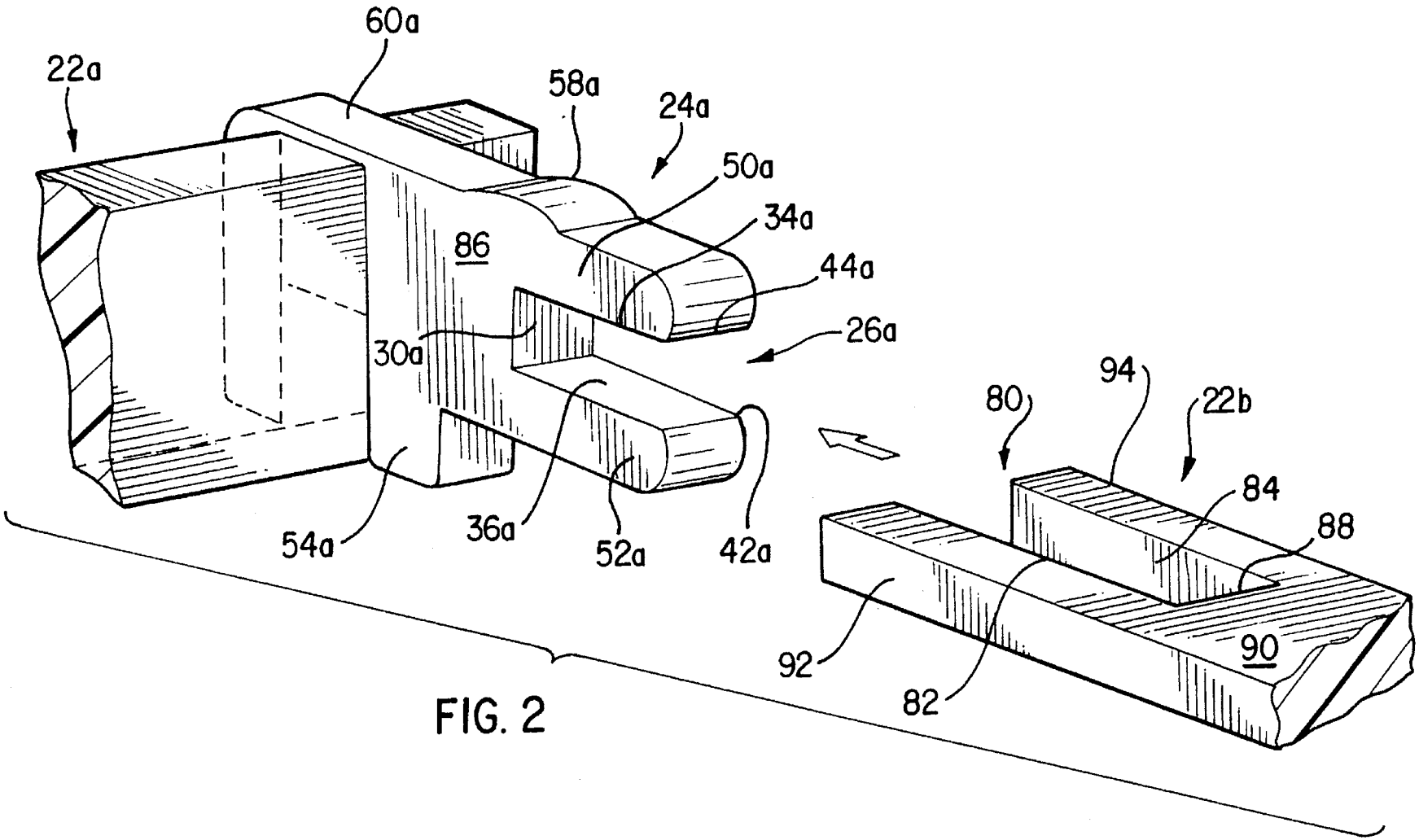
FIG. 2 is a perspective view illustrating how a connector puzzle piece interconnects two interlocking puzzle pieces of the present invention.
Figure 18:
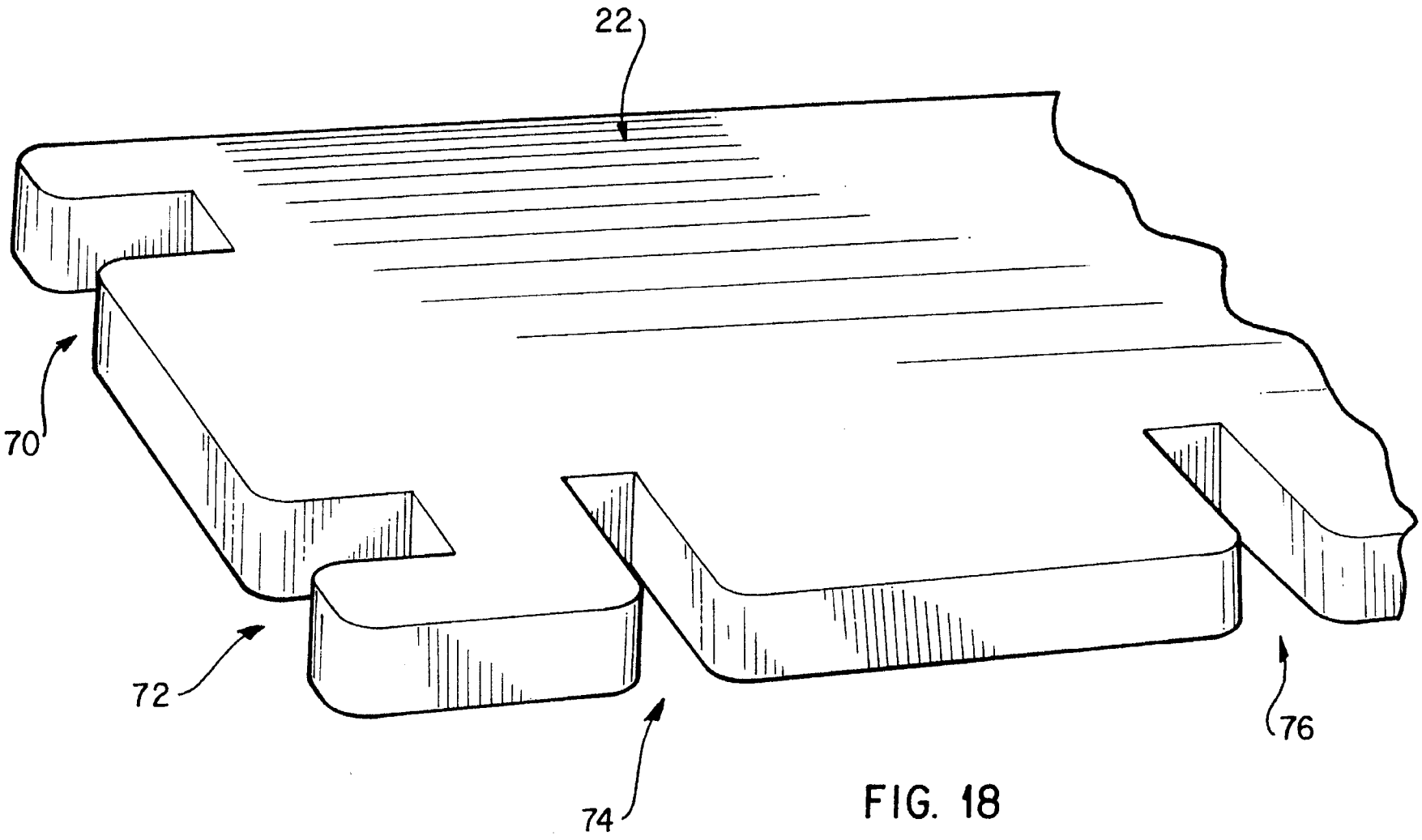
FIG. 18 illustrates an interlocking puzzle piece according to the present invention.

An example of an interlocking puzzle piece 22 is illustrated in FIG. 18. As illustrated in FIGS. 1 and 2, the puzzle pieces 22 are preferably larger than the connector pieces 24, and are adapted to be connected directly to other puzzle pieces 22 or the connector pieces 24. Each puzzle piece 22 preferably has at least one and preferably a plurality of joints, such as joints 70, 72, 74 and 76 illustrated in FIG. 18. The joints 70, 72, 74 and 76 have the same configuration as the joints of the connector pieces, and the top corners of each U-shaped opening of the joints 70, 72, 74 and 76 are also curved. Although no protrusions 58 or bumps 100, 102 are shown as being provided to support any of the legs, protrusions 58 or bumps 100, 102 can be provided without departing from the spirit and scope of the present invention. The puzzle pieces 22 may be provided in virtually any shape or size, depending upon the model structure to be constructed.

Although the specific connector pieces 24*a*–24*o* and puzzle pieces 22, 22*a* and 22*b* are being illustrated, it will be appreciated that many other connector pieces 24 and puzzle pieces 22 having different configurations and different numbers of interlocking joints can be provided without departing from the spirit and scope of the present invention. Thus, by providing a wide variety of connector pieces 24 and puzzle pieces 22, the present invention allows the user to assemble a large variety of three-dimensional objects.

The interlocking puzzle pieces 22 and the connector pieces 24 are preferably made from a soft material that is safe for use by children. A preferred material is foam, although other materials such as, but not limited to, plastic, wood, or paperboard, can be used without departing from the spirit and scope of the present invention. In addition, the surfaces and side edges of the puzzle pieces 22 and connector pieces 24 may be laminated with printed labels or may be directly printed with graphics, decals or other decorative images. The puzzle pieces 22 and connector pieces 24 are preferably thin, with a thickness of about ⅛ inch to ½ inch.

FIG. 2 illustrates how connector piece 24*a* of FIG. 3 interconnects two interlocking puzzle pieces 22*a* and 22*b*. In FIG. 2, the puzzle piece 22*a* is shown as a segment of a bar that extends in a plane that is transverse or orthogonal to the plane of the connector piece 24*a*, with the puzzle piece 22*b* extending in another plane that is transverse or orthogonal to the planes of the puzzle piece 22*a* and the connector piece 24*a*. Although only one joint 80 of the puzzle piece 22*b* is shown, the puzzle piece 22*b* could well have other joints to connect it to other connector pieces 24 or puzzle pieces 22.

The puzzle piece 22*b* is shown as having a joint 80 that is adapted to be interlockingly engaged or connected with the joint 26*a* of the connector piece 24*a*. To make the connection, the U-shaped opening of the joint 80 is inserted into the U-shaped opening of the joint 26*a* in the direction of the arrow shown in FIG. 2 in a manner in which the U-shaped openings of the two joints 26*a* and 80 are transverse to each other.

When the interlock connection is achieved, the inner side edges 82 and 84 of the U-shaped joint 80 are adapted to be adjacent or to contact the surfaces 86 of the body of the connector piece 24*a*, so that the legs 92 and 94 of the joint 80 essentially grip the body of the connector piece 24*a*. Likewise, the inner side edges 34*a* and 36*a* of the U-shaped joint 26*a* are adapted to be adjacent or to contact the surfaces 90 of the body of the puzzle piece 22*b*, so that the legs 50*a* and 52*a* of the joint 26*a* essentially grip the body of the puzzle piece 22*b*. Also, the bottom edge 88 of the joint 80 is adapted to contact or be adjacent the bottom edge 30*a* of joint 26*a*. Thus, the interlocking engagement or connection between joint 80 of puzzle piece 22*b* and joint 26*a* of connector piece 24*a* is about transverse, preferably orthogonal planes. In other words, after the interlocking engagement, the body of the puzzle piece 22*b* is in a plane that is orthogonal or transverse to the plane in which the body of the connector piece 24*a* is disposed. This transverse interlock connection provides a secure connection between the two joints 26*a* and 80 because of the "gripping" action of the legs 50*a*, 52*a*, 92 and 94.

In addition, the top corners of the joints 26*a* and 80 provide a wider opening that make it easier for inserting the body of the .other piece into the "grip" of its legs. For example, when the top corners 42*a* and 44*a* of joint 26*a* approach the bottom edge 88, the curvature creates a wider opening so that the top corners 42*a* and 44*a* will not brush against or become snagged by the body of the puzzle piece 22*b*, thereby allowing for the body of puzzle piece 22*b* to be smoothly inserted into the "grip" of the legs 50*a* and 52*a*. This also protects the legs 50*a* and 52*a* from damage and wear, thereby enhancing the durability of the connector piece 24*a*.

The puzzle piece 22*a* is shown in FIG. 2 after it has been interlockingly connected to the joint 28*a* of connector piece 24*a*. Puzzle piece 22*a* is interlockingly connected to the joint 28*a* of the connector 24*a* in the same manner as that described above for joints 26*a* and 80. The body of the puzzle piece 22*a* likewise extends in a plane which is orthogonal or transverse to the plane in which the body of the connector piece 24*a* is disposed. In fact, all the puzzle pieces 22 and connector pieces 24 are adapted to be interlockingly connected in the same manner.

To disengage an interlocked connection, for example the interlocked connection of joints 26*a* and 80, the puzzle piece 22*b* is pulled away from the connector piece 24*a* in a direction opposite the arrow shown in FIG. 2 to release the "grips" of the legs 50*a*, 52*a*, 92 and 94.

Figure 19:
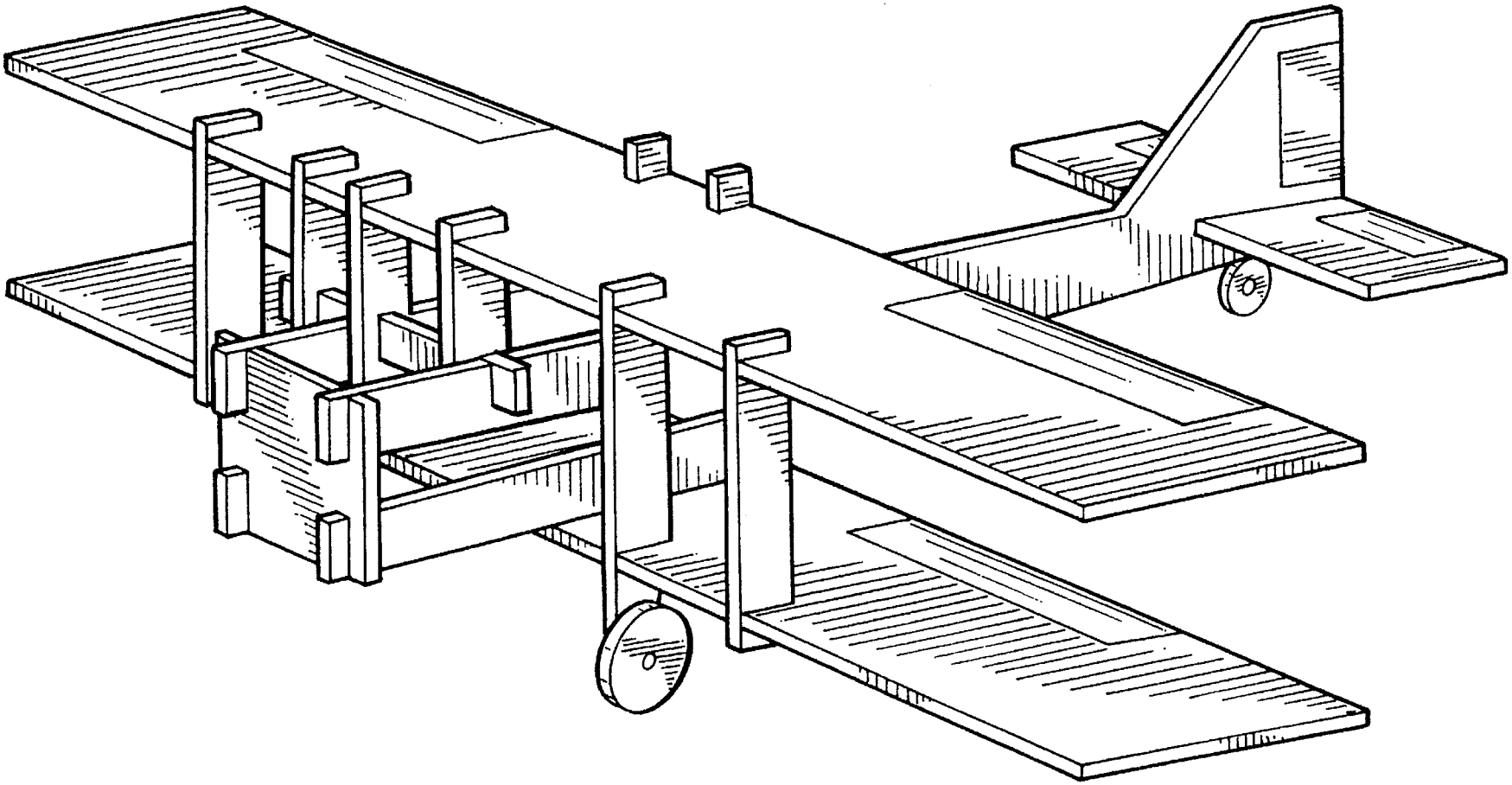
FIG. 19 is a perspective view of a three-dimensional model structure, a plane, assembled with the interlocking puzzle pieces according to the present invention.

Referring back to FIG. 1, it can be seen that the connector pieces 24 can be used to interconnect one or more puzzle pieces 22 and connector pieces 24. However, puzzle pieces 22 can be connected to each other without the use of connector pieces 24. For example, FIG. 19 illustrates a three-dimensional model plane that is assembled entirely by using puzzle pieces 22 only, without the use of any connector pieces 24. Likewise, three-dimensional objects can be assembled by merely connecting connector pieces 24 without using any puzzle pieces 22. In this manner, connector pieces 24 can also be considered puzzle pieces 22, and vice versa, since they all function to interconnect other pieces 22 and 24. Such flexibility in the use of the connector pieces 24 and puzzle pieces 22 tremendously enhances the variety of objects that can be assembled.

Thus, the puzzle pieces 22 and connector pieces 24 according to the present invention can be used to assemble a large variety of two and three-dimensional objects. The widened top corners of the joints of the puzzle pieces 22 and connector pieces 24 make it easy for the user to insert one joint into another to create the desired interlocking connection. In addition, the widened top corners and the protrusions or bumps also function to protect the legs of the joints, providing for a more durable set of puzzle pieces 22 and connector pieces 24 that can withstand careless and extended use.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. An object assembled by interconnecting a plurality of puzzle pieces, the object having at least one puzzle piece comprising:

at least three outer side edges including a first outer side edge;

at least one joint having a substantially U-shaped mortise defined by a first leg and a second leg, the U-shaped mortise comprising a bottom edge, and first and second inner side edges extending from the bottom edge, with the first leg defined by the first inner side edge and the first outer side edge; and a protrusion provided along the first outer side edge at a location substantially opposite the bottom edge of the joint.

2. The object of claim 1, wherein the at least three outer side edges of each puzzle piece comprises a second outer side edge and the U-shaped mortise defines an opening, wherein the first and second inner side edges are connected to the second outer side edge by curved corners to widen the opening defined by the U-shaped mortise.

3. The object of claim 1, wherein the at least three outer side edges of each puzzle piece comprises a second outer side edge and the U-shaped mortise defines an opening, wherein the first and second inner side edges are connected to the second outer side edge by chamfered corners to widen the opening defined by the U-shaped mortise.

4. The object of claim 1, comprising a first puzzle piece having a body and a joint and a second puzzle piece having a body and a joint, wherein the bodies of the first and second puzzle pieces are transverse to each other when the joint of the first puzzle piece is interconnected with the joint of the second puzzle piece.

5. The object of claim 4, wherein the inner side edges of the joint of the first puzzle piece grip the body of the second puzzle piece, and the inner side edges of the joint of the second puzzle piece grip the body of the first puzzle piece, when the joint of the first puzzle piece is interconnected with the joint of the second puzzle piece.

6. An object assembled by interconnecting a plurality of puzzle pieces, the object having at least one puzzle piece comprising:

at least three outer side edges;

at least one joint having a substantially U-shaped mortise defined by a first leg and a second leg, the U-shaped mortise comprising a bottom edge, and first and second inner side edges extending from the bottom edge, the joint of each puzzle piece further comprising a first corner between the first inner side edge and the bottom edge; and a bump provided at the first corner.

7. The object of claim 6, wherein the at least three outer side edges of each puzzle piece comprises a second outer side edge and the U-shaped mortise defines an opening, wherein the first and second inner side edges are connected to the second outer side edge by curved corners to widen the opening defined by the U-shaped mortise.

8. The object of claim 6, wherein the at least three outer side edges of each puzzle piece comprises a second outer side edge and the U-shaped mortise defines an opening, wherein the first and second inner side edges are connected to the second outer side edge by chamfered corners to widen the opening defined by the U-shaped mortise.

9. The object of claim 6, comprising a first puzzle piece having a body and a joint and a second puzzle piece having a body and a joint, wherein the bodies of the first and second puzzle pieces are transverse to each other when the joint of the first puzzle piece is interconnected with the joint of the second puzzle piece.

10. The object of claim 9, wherein the inner side edges of the joint of the first puzzle piece grip the body of the second puzzle piece, and the inner side edges of the joint of the second puzzle piece grip the body of the first puzzle piece, when the joint of the first puzzle piece is interconnected with the joint of the second puzzle piece.

* * * * *